US011413738B1

(12) United States Patent
Chen

(10) Patent No.: US 11,413,738 B1
(45) Date of Patent: Aug. 16, 2022

(54) TOOLBOX

(71) Applicant: MING SHIN TOOLS CO., LTD., Taichung (TW)

(72) Inventor: Yung-Shun Chen, Taichung (TW)

(73) Assignee: MING SHIN TOOLS CO., LTD., Taichung (TW)

( * ) Notice: Subject to any disclaimer, the term of this patent is extended or adjusted under 35 U.S.C. 154(b) by 65 days.

(21) Appl. No.: 17/166,200

(22) Filed: Feb. 3, 2021

(51) Int. Cl.
*B25H 3/02* (2006.01)

(52) U.S. Cl.
CPC ..... *B25H 3/02* (2013.01)

(58) Field of Classification Search
CPC .. B25H 3/00; B25H 3/02; A45C 13/04; A45C 13/02; A45C 13/26; A45C 13/1076
USPC ..... 206/349; 190/122, 124, 118, 120
See application file for complete search history.

(56) References Cited

U.S. PATENT DOCUMENTS 7,629,542 B1 * 12/2009 Harding ..... G01G 19/58 177/148
7,832,584 B2 * 11/2010 Eggers ..... B25H 3/023 312/111
11,325,242 B1 * 5/2022 Chen ..... B25H 3/022
2014/0332423 A1 * 11/2014 Lee ..... B25H 3/02 206/349
2017/0000232 A1 * 1/2017 Scicluna ..... A45C 13/04
2020/0268118 A1 * 8/2020 Fabbri ..... A45F 3/04

* cited by examiner

*Primary Examiner* — Rafael A Ortiz
*Assistant Examiner* — Sanjidul Islam
(74) *Attorney, Agent, or Firm* — Muncy, Geissler, Olds & Lowe, P.C.

(57) ABSTRACT

A toolbox is provided, including a first shell body, a second shell body and at least one locking assembly. The first shell body includes a first flange and a first frame disposed on the first flange. The second shell body is rotatably connected with the first shell body. The second shell body includes a second flange and a second frame disposed on the second flange. The at least one locking assembly includes a first locking unit, a second locking unit, first positioning members and second positioning members. The first locking unit is connected with the first frame through the first positioning members. The second locking unit is connected with the second frame through the second positioning members. Each of the first positioning members is disposed through the first frame. Each of the second positioning members is disposed through the second frame.

10 Claims, 8 Drawing Sheets

TOOLBOX

BACKGROUND OF THE INVENTION

Field of the Invention

The present invention relates to a toolbox.

Description of the Prior Art

A toolbox is a container used to store various tools and parts, and it is conveniently portable and provides good protection to the tools and parts. The conventional toolbox focuses on protection to the tools and parts, and it is usually made of metal, which results in being heavy and easy to rust. Furthermore, the sharp edges of the metal material are easy to damage and hurt the user. Therefore, most of the toolbox materials today are made of plastic.

However, the structural strength of the toolbox made of plastic is weak. When locking members, hinges and other connecting elements are attached to the toolbox, it can cause damage to the structure of the toolbox and can make the toolbox fragile. After the toolbox is used for a period of time, portions of the toolbox on which the locking members, hinges and connecting elements are mounted are easy to bend, deform and/or break off, which results in a shorter service life.

The present invention is, therefore, arisen to obviate or at least mitigate the above-mentioned disadvantages.

SUMMARY OF THE INVENTION

The main object of the present invention is to provide a toolbox which is made of plastic material and metal connected by positioning members disposed through them and has light weight and strong structure.

To achieve the above and other objects, the present invention provides a toolbox, including: a first shell body, including a first main body and a first frame, the first main body including a first flange, the first frame including two first side walls and a first cover portion, the two first side walls being respectively connected to two opposite ends of the first cover portion to define a first receiving room and a first opening, the first flange being inserted through the first opening and within the first receiving room, the first flange being made of plastic material, the first frame being made of metal; a second shell body, movably connected with the first shell body, including a second main body and a second frame, the second main body including a second flange, the second frame including two second side walls and a second cover portion, the two second side walls being respectively connected to two opposite ends of the second cover portion to define a second receiving room and a second opening, the second flange being inserted through the second opening and within the second receiving room, the second flange being made of plastic material, the second frame being made of metal, when the first shell body and the second shell body are closed, the first cover portion and the second cover portion are abutted against each other; and at least one locking assembly, including a first locking unit, a second locking unit, a plurality of first positioning members and a plurality of second positioning members, each of the plurality of first positioning members including a first connection portion and two first blocking portions, the first connection portion being disposed through the first locking unit, the first flange and the two first side walls, the two first blocking portions respectively extending laterally from two opposite ends of the first connection portion, in a longitudinal direction of the first connection portion the two first blocking portions being respectively overlapped with the first locking unit and a the first side wall so that the first locking unit is secured to one of the two first side walls, each of the plurality of second positioning members including a second connection portion and two second blocking portions, the second connection portion being disposed through the second locking unit, the second flange and the two second side walls, the two second blocking portions respectively extending laterally from two opposite ends of the second connection portion, in a longitudinal direction of the second connection portion the two second blocking portions being respectively overlapped with the second locking unit and a the second side wall so that the second locking unit is secured to one of the two second side walls, the second locking unit being lockable with the first locking unit to releasably lock the second shell body and the first shell body.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
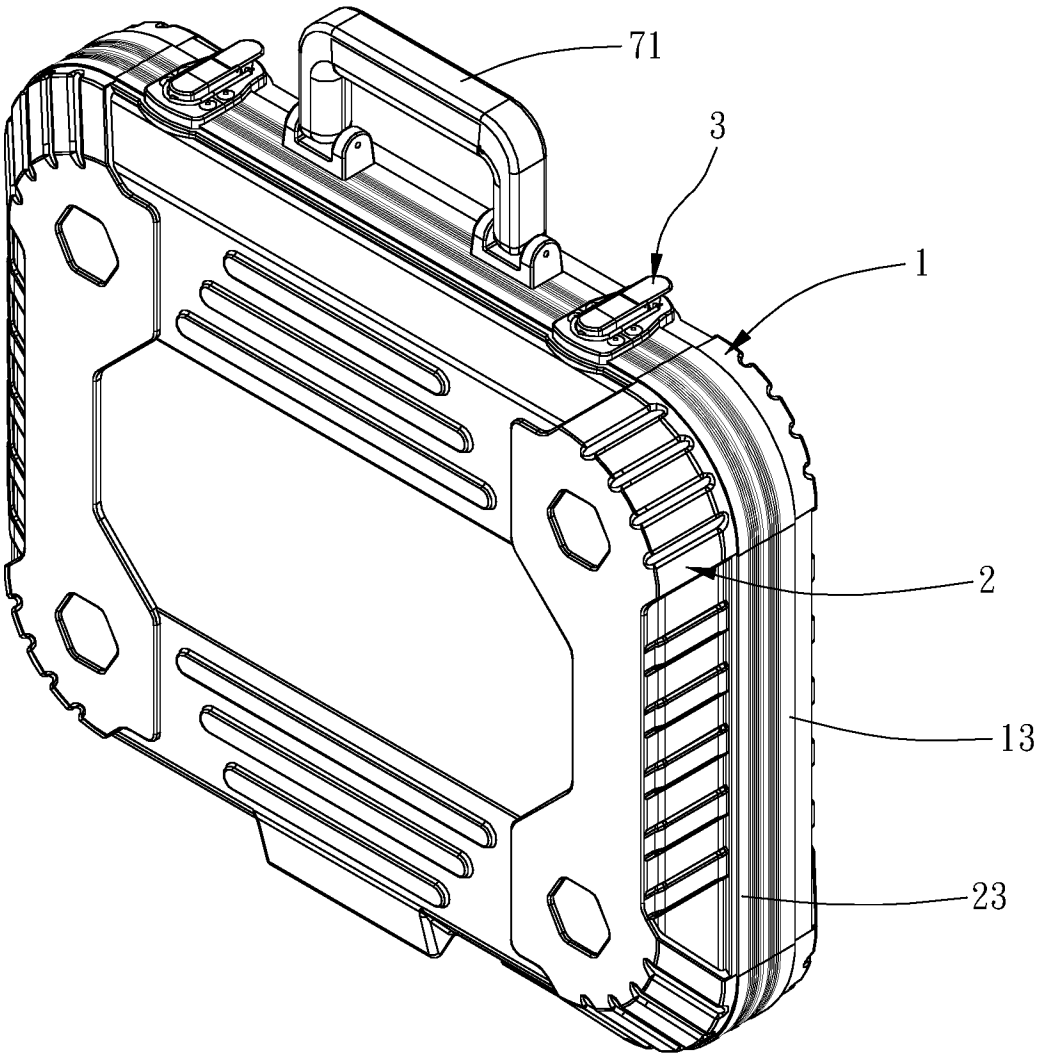
FIG. 1 is a stereogram of a preferable embodiment of the present invention.
Figure 2:
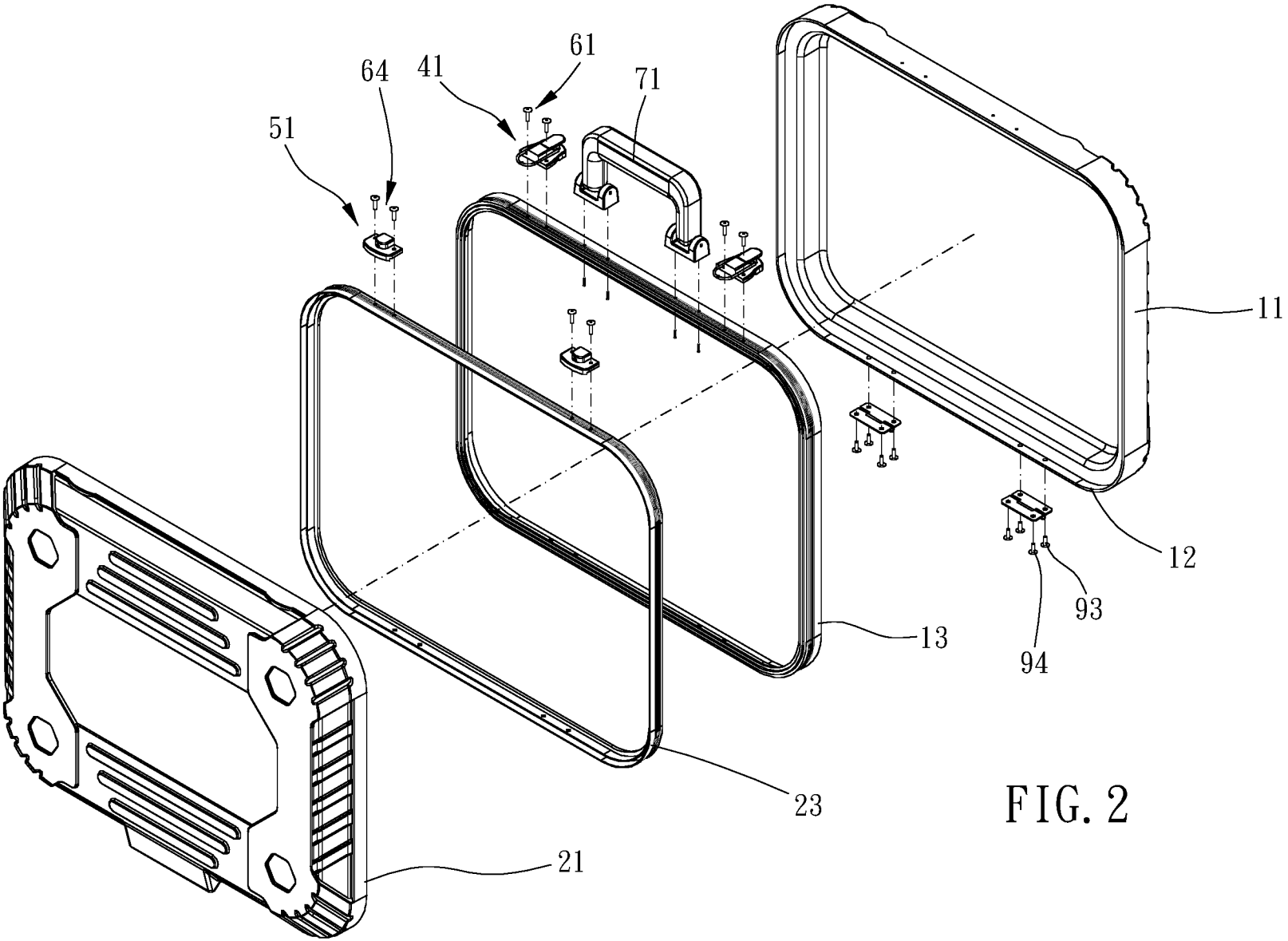
FIG. 2 is a breakdown drawing of FIG. 1.
Figure 3:
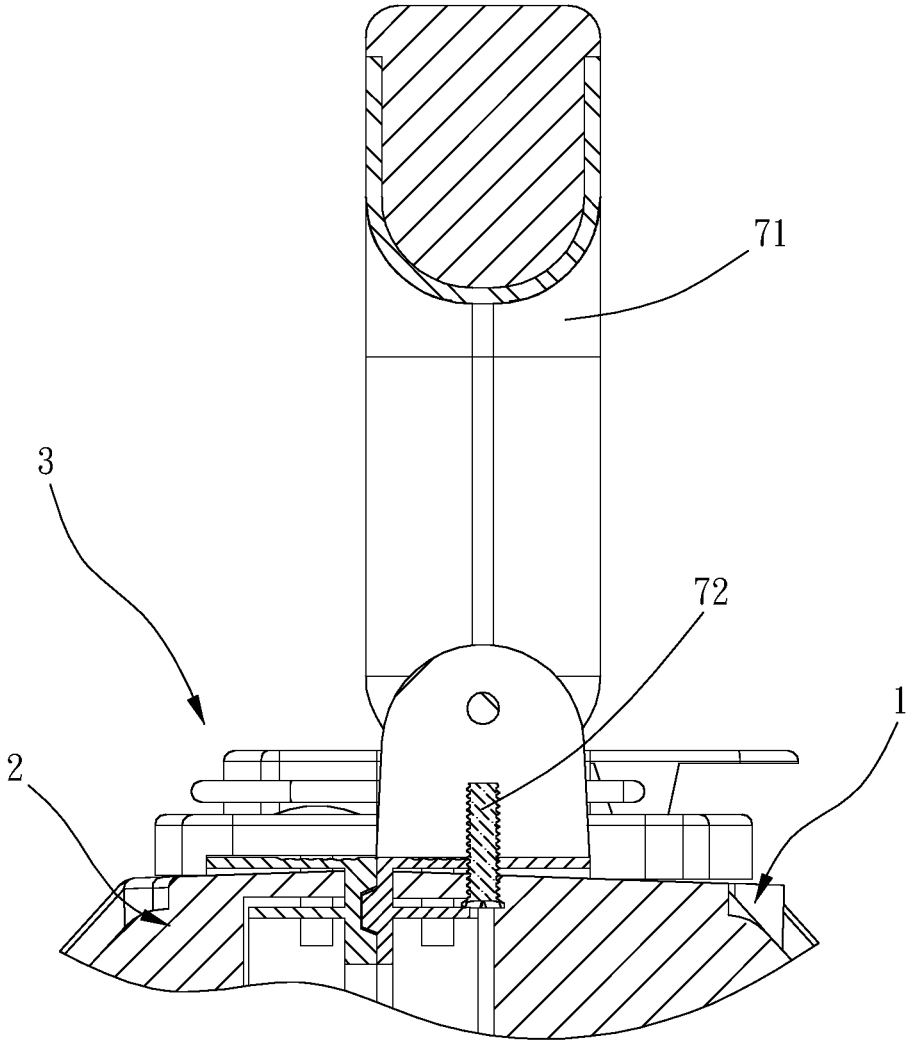
FIG. 3 is a cross-sectional view showing a grip connected with a first shell body according to a preferable embodiment of the present invention.
Figure 4:
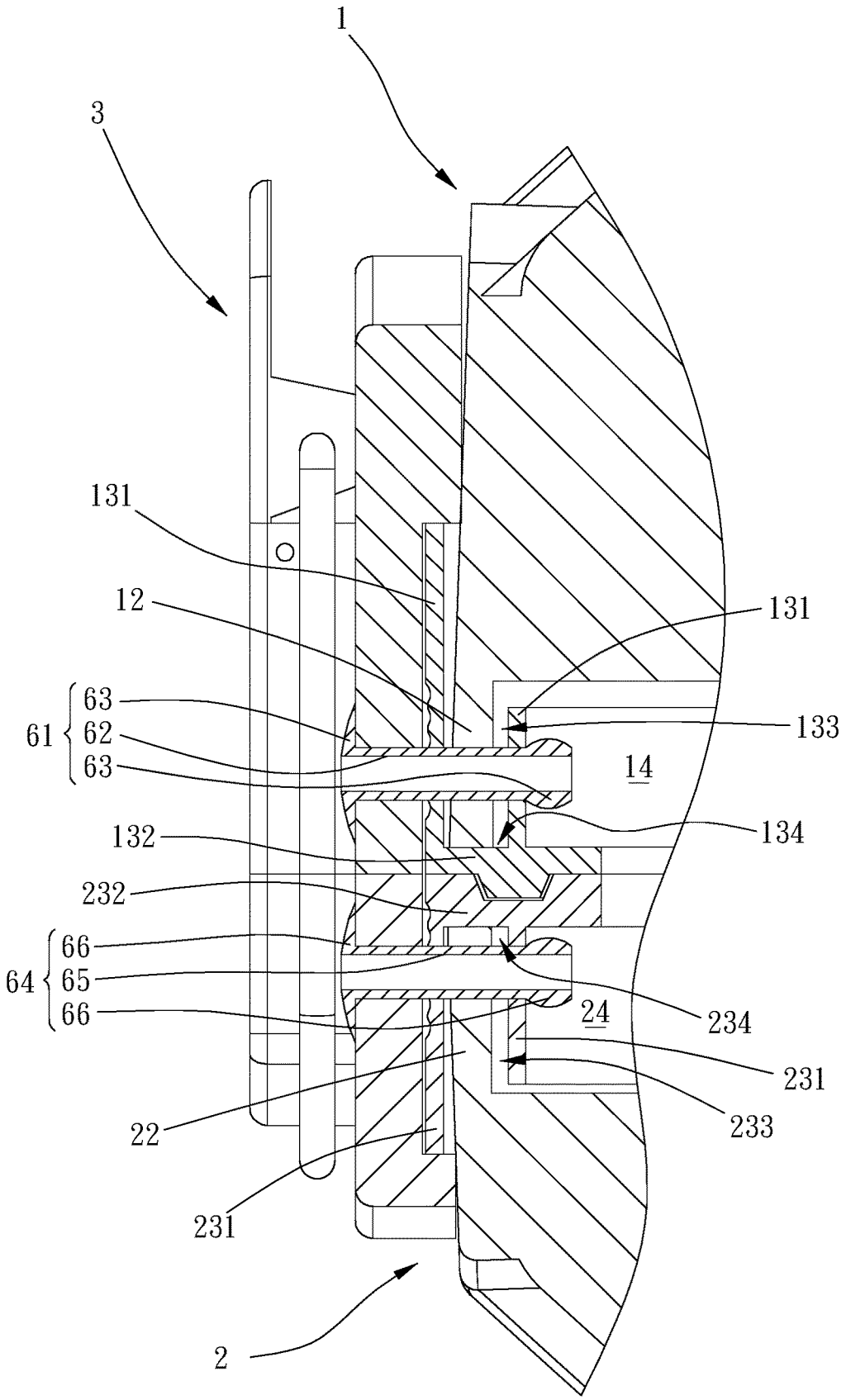
FIG. 4 is a cross-sectional view showing a locking assembly connected with the first shell body and a second shell body according to a preferable embodiment of the present invention.
Figure 5:
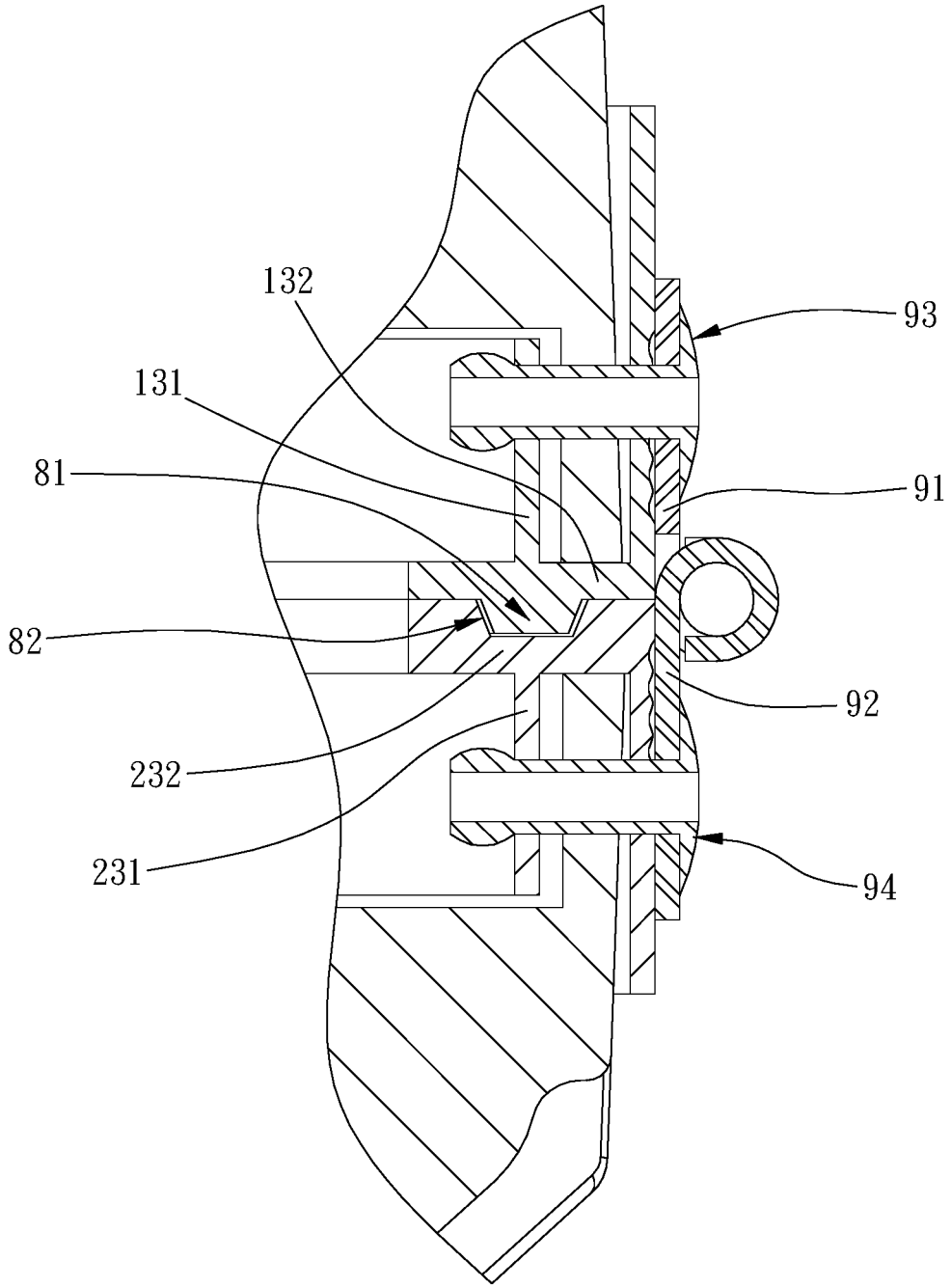
FIG. 5 is a cross-sectional view showing a rotatable assembly connected with the first shell body and the second shell body according to a preferable embodiment of the present invention.
Figure 6:
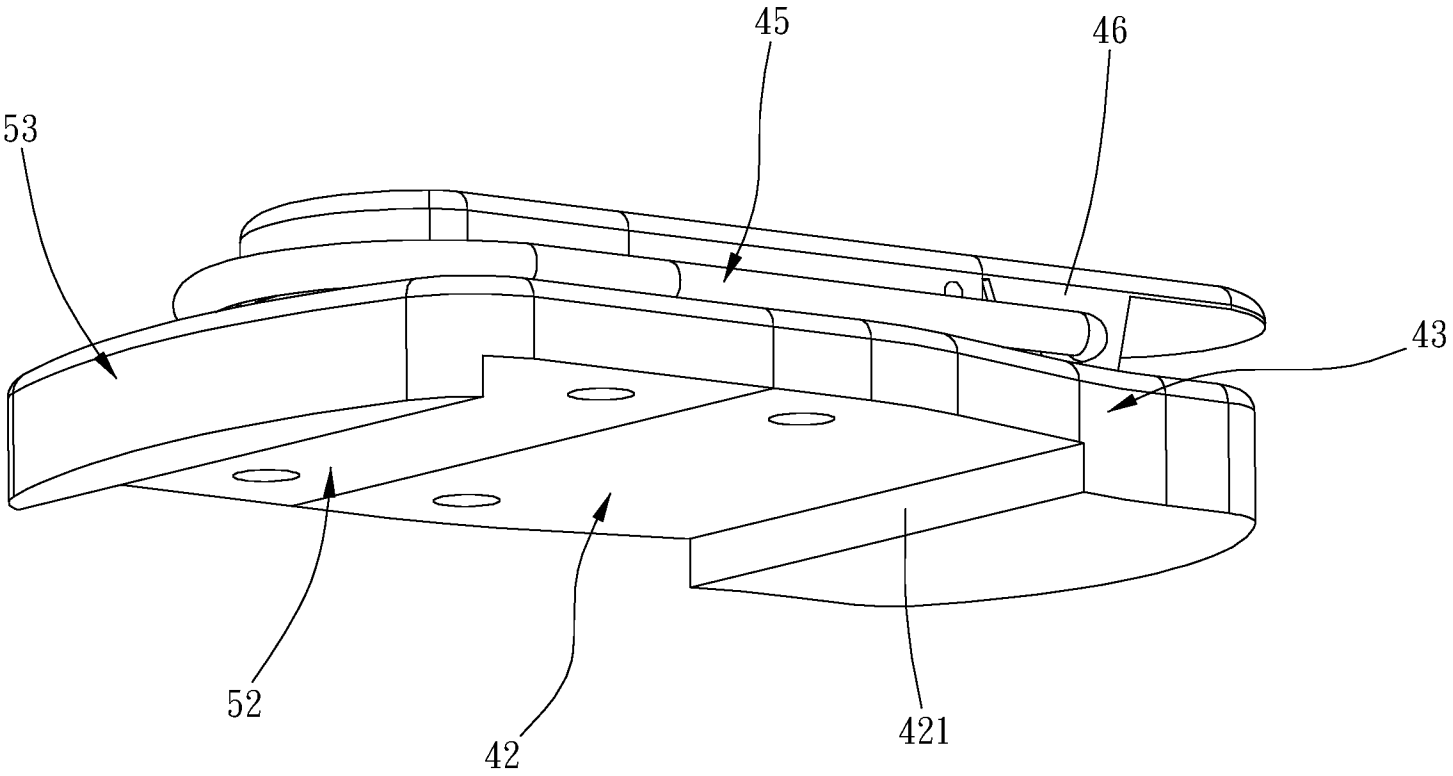
FIG. 6 is a stereogram of the locking assembly according to a preferable embodiment of the present invention.
Figure 7:
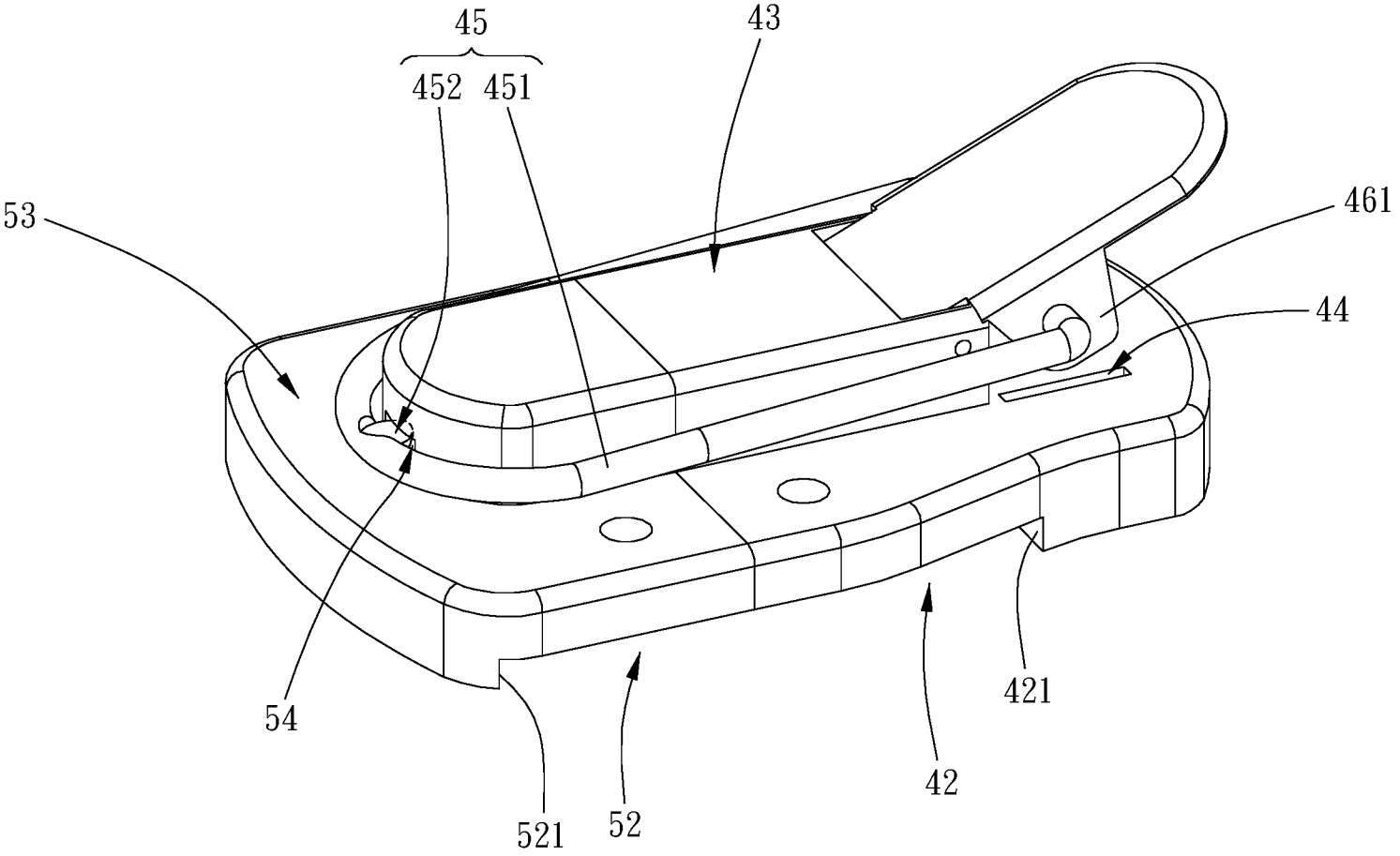
FIG. 7 is another stereogram of the locking assembly according to a preferable embodiment of the present invention.

Please refer to FIGS. 1 to 7 for a preferable embodiment of the present invention. A toolbox of the present invention includes a first shell body 1, a second shell body 2 and at least one locking assembly 3.

The first shell body 1 includes a first main body 11 and a first frame 13, the first main body 11 includes a first flange 12, the first frame 13 includes two first side walls 131 and a first cover portion 132, and the two first side walls 131 are respectively connected to two opposite ends of the first cover portion 132 to define a first receiving room 133 and a first opening 134. The first flange 12 is inserted through the first opening 134 and within the first receiving room 133. The first flange 12 is made of plastic material, and the first frame 13 is made of metal such as aluminum.

The second shell body 2 is movably connected with the first shell body 1. The second shell body 2 includes a second main body 21 and a second frame 23, the second main body 21 includes a second flange 22, the second frame 23 includes two second side walls 231 and a second cover portion 232, and the two second side walls 231 are respectively connected to two opposite ends of the second cover portion 232 to define a second receiving room 233 and a second opening 234. The second flange 22 is inserted through the second opening 234 and within the second receiving room 233. The second flange 22 is made of plastic material, and the second frame 23 is made of metal. When the first shell body 1 and the second shell body 2 are closed, the first cover portion 132 and the second cover portion 232 are abutted against each other.

The at least one locking assembly 3 includes a first locking unit 41, a second locking unit 51, a plurality of first positioning members 61 and a plurality of second positioning members 64. Each of the plurality of first positioning members 61 includes a first connection portion 62 and two first blocking portions 63, the first connection portion 62 is disposed through the first locking unit 41, the first flange 12 and the two first side walls 131, and the two first blocking portions 63 respectively extend laterally from two opposite ends of the first connection portion 62. In a longitudinal direction of the first connection portion 62 the two first blocking portions 63 are respectively overlapped with the first locking unit 41 and a the first side wall 131 so that the first locking unit 41 is secured to one of the two first side walls 131. Whereby, the weight of the first locking unit 41 and external force can be distributed on the first frame 13 which has strong structural strength, so that the first locking unit 41 is much durable as well as the toolbox. Each of the plurality of second positioning members 64 includes a second connection portion 65 and two second blocking portions 66, the second connection portion 65 is disposed through the second locking unit 51, the second flange 22 and the two second side walls 231, and the two second blocking portions 66 respectively extend laterally from two opposite ends of the second connection portion 65. In a longitudinal direction of the second connection portion 65 the two second blocking portions 66 are respectively overlapped with the second locking unit 51 and a the second side wall 231 so that the second locking unit 51 is secured to one of the two second side walls 231. The second locking unit 51 and the first locking unit 41 are lockable with each other to releasably lock the second shell body 2 and the first shell body 1.

In this embodiment, the first main body 11 is a blow-molded plastic body, the second main body 21 is a blow-molded plastic body, and each of the plurality of first positioning members 61 and the plurality of second positioning members 64 is a rivet. The toolbox further includes a grip 71, and at least one threaded member 72 is disposed through the first frame 13 and the first flange 12 and is connected with the grip 71, which provides good stability, firmness and structural strength.

The second shell body 2 and the first shell body 1 are connected with each other by a plurality of rotatable assemblies 9. Specifically, each of the plurality of rotatable assemblies 9 includes a first rotatable unit 91, a second rotatable unit 92, a plurality of third positioning members 93 and a plurality of fourth positioning members 94. Each of the plurality of third positioning members 93 is disposed through the first rotatable unit 91, the first flange 12 and the two first side walls 131 so that the first rotatable unit 91 is securedly connected to the first frame 13. Each of the plurality of fourth positioning members 94 is disposed through the second rotatable unit 92, the second flange 22 and the two second side walls 231 so that the second rotatable unit 92 is securedly connected to the second frame 23. The second rotatable unit 92 is rotatably connected with the first rotatable unit 91. Specifically, the at least one locking assembly includes a plurality of locking assemblies 3, and the plurality of the locking assemblies 3 and the plurality of rotatable assemblies 9 are respectively disposed on two opposite sides of the toolbox. The plurality of first positioning members 61, the plurality of second positioning members 64, the plurality of third positioning members 93 and the plurality of fourth positioning members 94 have the same structure, which can distribute force to the first frame 13 or the second frame 23.

In this embodiment, the first shell body 1 further includes a first receiving space 14 for receiving articles, and one of the two first blocking portions 63 remote from the first locking unit 41 is exposed within the first receiving space 14, which allows viewing on the first blocking portion 63. The second shell body 2 further includes a second receiving space 24, and one of the two second blocking portions 66 remote from the second locking unit 51 is exposed within the second receiving space 24.

Specifically, the first locking unit 41 includes a first base portion 43, a retainer 45 and a lever 46, and the second locking unit 51 includes a second base portion 53 and an engaging hole 54. The first base portion 43 is connected to the first shell body 1 by the plurality of first positioning members 61, the second base portion 53 is connected to the second shell body 2 by the plurality of second positioning members 64, the lever 46 is rotatably connected to the first base portion 43, and the retainer 45 is rotatably connected to and movable with the lever 46 and is configured to securedly hoop on the second base portion 53. The retainer 45 includes an annular body 451 and an engaging portion 452 connected with the annular body 451, and when the annular body 451 is securedly hooped on the second base portion 53, the engaging portion 452 is engaged within the engaging hole 54, which enhances combination of the retainer 45 and the second base portion 53.

In this embodiment, the engaging portion 452 is integrally connected with the annular body 451, and the engaging portion 452 is a stamped fan-shaped plate for good engagement thereof within the engaging hole 54. The retainer 45 is inserted within two wings 461 of the lever 46, the first base portion 43 includes two insertion holes 44, and when the retainer 45 is securedly hooped on the second base portion 53, the two wings 461 are respectively inserted within the two insertion holes 44, which provides good stability of the lever 46 and makes the lever 46 much close to the first base portion 43 for avoiding unintentional release of the retainer 45.

The first locking unit 41 includes a first recessed portion 42 on a side facing toward the first shell body 1. One of the two first side walls 131 adjacent to the first locking unit 41 is partially received within the first recessed portion 42 so that the first locking unit 41 and the first frame 13 are more effectively secured. The second locking unit 51 includes a second recessed portion 52 on a side facing toward the second shell body 2. One of the two second side walls 231 adjacent to the second locking unit 51 is partially received within the second recessed portion 52.

Preferably, the first base portion 43 includes the first recessed portion 42, and the second base portion 53 includes the second recessed portion 52. A portion of the first recessed portion 42 within the first side wall 131 is abutted against a first stepped face 421 of the first recessed portion 42, and thus the first side wall 131 can stably support the first base portion 43. A portion of the second recessed portion 52 within the second side wall 231 is abutted against a second stepped face 521 of the second recessed portion 52.

One of the first cover portion 132 and the second cover portion 232 includes a projection 81, and the other of the first cover portion 132 and the second cover portion 232 includes a recess 82. When the first shell body 1 and the second shell body 2 are closed, the projection 81 is engaged within the recess 82. Preferably, the projection 81 is tapered in a direction toward the recess 82, which is advantageous for guiding the projection 81 into the recess 82.

In this embodiment, the first cover portion 132 includes the projection 81, the second cover portion 232 includes the recess 82, one of the two first side walls 131 remote from the first locking unit 41 straightly extends through a central axis of the projection 81, and one of the two second side walls 231 remote from the second locking unit 51 straightly extends through a central axis of the recess 82. The recess 82 and the projection 81 are, for example, shaped to be complementary to each other. The recess 82 may be in a U-shaped or other suitable geometric shape.

Figure 8:
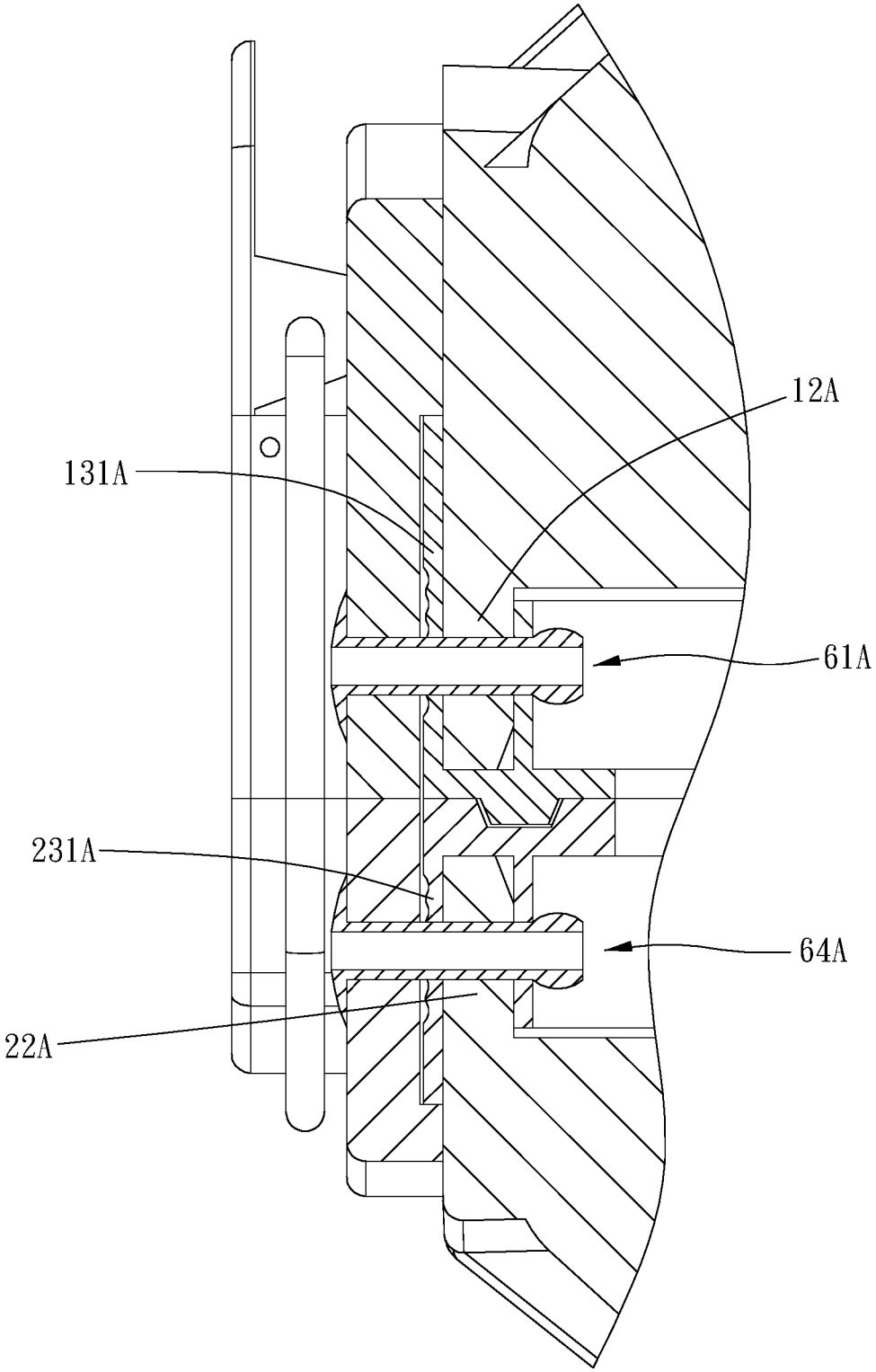
FIG. 8 is a drawing showing operation of another preferable embodiment of the present invention.

In an alternative embodiment as shown in FIG. 8, preferably, a portion of the first flange 12A through which the first positioning member 61A is disposed is laterally abutted against the two first side walls 131A, which provides a tight-fit configuration which enhances the combination of the first flange 12A and the two first side walls 131A. A portion of the second flange 22A through which the second positioning member 64A is disposed is laterally abutted against the two second side walls 231A.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A toolbox, including:

a first shell body, including a first main body and a first frame, the first main body including a first flange, the first frame including two first side walls and a first cover portion, the two first side walls being respectively connected to two opposite ends of the first cover portion to define a first receiving room and a first opening, the first flange being inserted through the first opening and within the first receiving room, the first flange being made of plastic material, the first frame being made of metal;

a second shell body, movably connected with the first shell body, including a second main body and a second frame, the second main body including a second flange, the second frame including two second side walls and a second cover portion, the two second side walls being respectively connected to two opposite ends of the second cover portion to define a second receiving room and a second opening, the second flange being inserted through the second opening and within the second receiving room, the second flange being made of plastic material, the second frame being made of metal, when the first shell body and the second shell body are closed, the first cover portion and the second cover portion are abutted against each other; and at least one locking assembly, including a first locking unit, a second locking unit, a plurality of first positioning members and a plurality of second positioning members, each of the plurality of first positioning members including a first connection portion and two first blocking portions, the first connection portion being disposed through the first locking unit, the first flange and the two first side walls, the two first blocking portions respectively extending laterally from two opposite ends of the first connection portion, in a longitudinal direction of the first connection portion the two first blocking portions being respectively overlapped with the first locking unit and a the first side wall so that the first locking unit is secured to one of the two first side walls, each of the plurality of second positioning members including a second connection portion and two second blocking portions, the second connection portion being disposed through the second locking unit, the second flange and the two second side walls, the two second blocking portions respectively extending laterally from two opposite ends of the second connection portion, in a longitudinal direction of the second connection portion the two second blocking portions being respectively overlapped with the second locking unit and a the second side wall so that the second locking unit is secured to one of the two second side walls, the second locking unit being lockable with the first locking unit to releasably lock the second shell body and the first shell body.

2. The toolbox of claim 1, wherein the first locking unit includes a first recessed portion on a side facing toward the first shell body, and one of the two first side walls adjacent to the first locking unit is partially received within the first recessed portion; the second locking unit includes a second recessed portion on a side facing toward the second shell body, and one of the two second side walls adjacent to the second locking unit is partially received within the second recessed portion.

3. The toolbox of claim 1, wherein the first shell body further includes a first receiving space, one of the two first blocking portions remote from the first locking unit is exposed within the first receiving space; the second shell body further includes a second receiving space, and one of the two second blocking portions remote from the second locking unit is exposed within the second receiving space.

4. The toolbox of claim 1, further including a grip, wherein at least one threaded member is disposed through the first frame and the first flange and is connected with the grip.

5. The toolbox of claim 1, wherein the first locking unit includes a first base portion, a retainer and a lever, the second locking unit includes a second base portion and an engaging hole, the first base portion is connected to the first shell body by the plurality of first positioning members, the second base portion is connected to the second shell body by the plurality of second positioning members, the lever is rotatably connected to the first base portion, the retainer is rotatably connected to and movable with the lever and is configured to securely hoop on the second base portion; the retainer includes an annular body and an engaging portion connected with the annular body, and when the annular body is securely hooped on the second base portion, the engaging portion is engaged within the engaging hole.

6. The toolbox of claim 5, wherein the retainer is inserted within two wings of the lever, the first base portion includes two insertion holes, and when the retainer is securedly hooped on the second base portion, the two wings are respectively inserted within the two insertion holes.

7. The toolbox of claim 1, wherein a portion of the first flange through which the first positioning member is disposed is laterally abutted against the two first side walls, and a portion of the second flange through which the second positioning member is disposed is laterally abutted against the two second side walls.

8. The toolbox of claim 1, wherein one of the first cover portion and the second cover portion includes a projection, the other of the first cover portion and the second cover portion includes a recess, and when the first shell body and the second shell body are closed, the projection is engaged within the recess, and the projection is tapered in a direction toward the recess.

9. The toolbox of claim 8, wherein the first cover portion includes the projection, the second cover portion includes the recess, one of the two first side walls remote from the first locking unit straightly extends through a central axis of the projection, and one of the two second side walls remote from the second locking unit straightly extends through a central axis of the recess.

10. The toolbox of claim 6, wherein the first locking unit includes a first recessed portion on a side facing toward the first shell body, and one of the two first side walls adjacent to the first locking unit is partially received within the first recessed portion; the second locking unit includes a second recessed portion on a side facing toward the second shell body, and one of the two second side walls adjacent to the second locking unit is partially received within the second recessed portion; the first shell body further includes a first receiving space, one of the two first blocking portions remote from the first locking unit is exposed within the first receiving space; the second shell body further includes a second receiving space, and one of the two second blocking portions remote from the second locking unit is exposed within the second receiving space; the toolbox further includes a grip, and at least one threaded member is disposed through the first frame and the first flange and connected with the grip; one of the first cover portion and the second cover portion includes a projection, the other of the first cover portion and the second cover portion includes a recess, and when the first shell body and the second shell body are closed, the projection is engaged within the recess, and the projection is tapered in a direction toward the recess; the first cover portion includes the projection, the second cover portion includes the recess, one of the two first side walls remote from the first locking unit straightly extends through a central axis of the projection, and one of the two second side walls remote from the second locking unit straightly extends through a central axis of the recess; the first main body is a blow-molded plastic body, and the second main body is a blow-molded plastic body; each of the plurality of first positioning members and the plurality of second positioning members is a rivet; the second shell body and the first shell body are connected with each other by a plurality of rotatable assemblies; each of the plurality of rotatable assemblies includes a first rotatable unit, a second rotatable unit, a plurality of third positioning members and a plurality of fourth positioning members, each of the plurality of third positioning members is disposed through the first rotatable unit, the first flange and the two first side walls so that the first rotatable unit is securedly connected to the first frame, each of the plurality of fourth positioning members is disposed through the second rotatable unit, the second flange and the two second side walls so that the second rotatable unit is securedly connected to the second frame, and the second rotatable unit is rotatably connected with the first rotatable unit; the at least one locking assembly includes a plurality of locking assemblies, the plurality of the locking assemblies and the plurality of rotatable assemblies are respectively disposed on two opposite sides of the toolbox; the plurality of first positioning members, the plurality of second positioning members, the plurality of third positioning members and the plurality of fourth positioning members have the same structure; a portion of the first side wall within the first recessed portion is abutted against a first stepped face of the first recessed portion, and a portion of the second side wall within the second recessed portion is abutted against a second stepped face of the second recessed portion; the engaging portion is integrally connected with the annular body, the engaging portion is a stamped fan-shaped plate; the recess and the projection are shaped to be complementary to each other; the first base portion includes the first recessed portion, and the second base portion includes the second recessed portion.

* * * * *